US008591383B1

(12) United States Patent
Mcalpin et al.

(10) Patent No.: US 8,591,383 B1
(45) Date of Patent: Nov. 26, 2013

(54) CHEERLEADER SUPPORT SYSTEM

(76) Inventors: Patrick K. Mcalpin, New Port Richey, FL (US); Mariah Candace Mcalpin, New Port Richey, FL (US); Kiana Kalin Mcalpin, New Port Richey, FL (US)

( * ) Notice: Subject to any disclaimer, the term of this patent is extended or adjusted under 35 U.S.C. 154(b) by 466 days.

(21) Appl. No.: 12/804,218

(22) Filed: Jul. 16, 2010

Related U.S. Application Data

(60) Provisional application No. 61/226,362, filed on Jul. 17, 2009.

(51) Int. Cl.
*A63B 4/00* (2006.01)

(52) U.S. Cl.
USPC ..... 482/34; 482/23

(58) Field of Classification Search
USPC ..... 482/23, 25, 34, 15, 18, 142, 148; 297/175, 187, 195.1, 423.1
See application file for complete search history.

(56) References Cited

U.S. PATENT DOCUMENTS

| | | | | |
|---|---|---|---|---|
| 4,448,411 | A * | 5/1984 | Parker | 482/34 |
| 4,850,588 | A * | 7/1989 | Desjardins et al. | 482/51 |
| 5,810,751 | A * | 9/1998 | Meier et al. | 601/24 |
| 5,865,710 | A * | 2/1999 | Wilson-Hyde | 482/52 |
| 6,071,212 | A * | 6/2000 | Hodlmoser | 482/25 |
| 7,112,168 | B2 * | 9/2006 | Dalebout et al. | 482/146 |
| 7,722,506 | B2 * | 5/2010 | Pratson et al. | 482/52 |
| 7,794,378 | B2 * | 9/2010 | Splane et al. | 482/142 |
| 2004/0248714 | A1 * | 12/2004 | Johnsen | 482/142 |
| 2006/0232109 | A1 * | 10/2006 | Olano | 297/195.11 |
| 2008/0020900 | A1 * | 1/2008 | Wang | 482/25 |

* cited by examiner

*Primary Examiner* — LoAn H. Thanh
*Assistant Examiner* — Sundhara Ganesan

(57) ABSTRACT

A vertically oriented shaft has a vertically oriented central axis. A lower plate has a configuration with an upper surface integrally formed with the lower end of the shaft. An upper plate has a geometric configuration having a lower surface integrally formed with the upper end of the shaft and having an upper surface. A base plate has a center located on the central axis of the shaft. The base plate has an upper surface in facing contact with and separably coupled to the lower surface of the lower plate.

1 Claim, 2 Drawing Sheets

FIG. 3
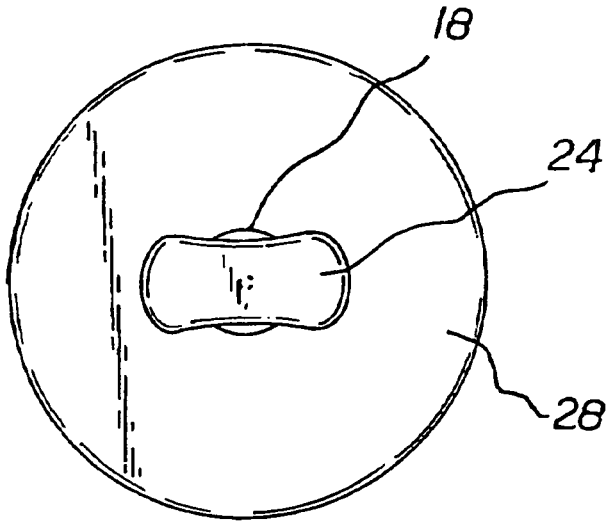
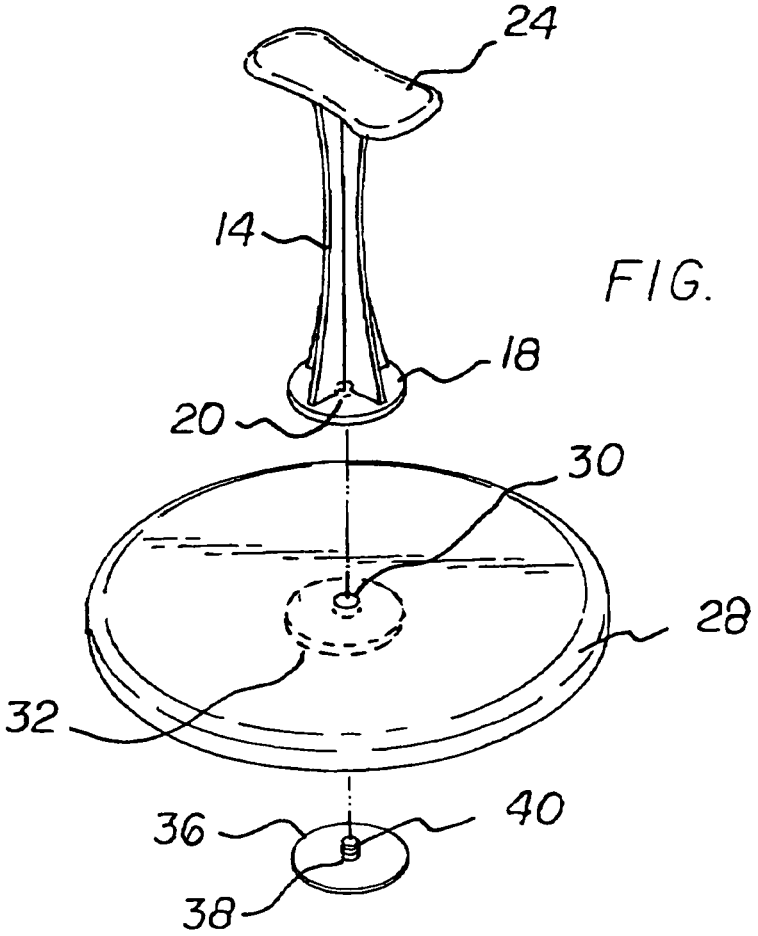
FIG. 4

CHEERLEADER SUPPORT SYSTEM

RELATED APPLICATION

The present non-provisional patent application is based upon pending Provisional Patent Application Ser. No. 61/226,362 filed Jul. 17, 2009, the subject matter of which is incorporated herein by reference.

BACKGROUND OF THE INVENTION

Field of the Invention

The present invention relates to a cheerleader support system and more particularly pertains to receiving and holding a cheerleader in a predetermined position while practicing athletic routines requiring balance and stamina, the receiving and holding being done in a safe, convenient and economical manner.

SUMMARY OF THE INVENTION

In view of the foregoing disadvantages inherent in the known types of support systems of known designs and configurations now present in the prior art, the present invention provides an improved cheerleader support system. As such, the general purpose of the present invention, which will be described subsequently in greater detail, is to provide a new and improved cheerleader support system and method which has all the advantages of the prior art and none of the disadvantages.

To attain this, the present invention essentially comprises a cheerleader support system. First provided is a vertically oriented central shaft. The central shaft has an upper end. The central shaft has a lower end. The central shaft has a vertically oriented central axis. The central axis is provided between the upper and lower ends. The central axis has a length of 14 inches, plus or minus 10 percent. The central has two planar sheets. The planar sheets are provided in a crossing pattern. The planar sheets have concave outer edges. The central shaft has a maximum width. The maximum width is provided adjacent to the upper and lower ends. The maximum width is not greater than 6 inches.

A lower plate is provided. The lower plate has a configuration with a center. The center is located on the central axis of the central shaft. The lower plate has a flat upper surface. The upper surface is integrally formed with the lower end of the central shaft. The lower plate has a diameter.

The diameter is 4 inches, plus or minus 10 percent. The lower plate has a flat lower surface. The lower plate has a central aperture.

Provided next is an upper plate. The upper plate has a generally rectangular configuration. The upper plate has short sides. The upper plate has concave long sides. The upper plate has a flat lower surface. The lower surface is integrally formed with the upper end of the central shaft. The upper plate has a maximum length. The maximum length is 9 inches, plus or minus 10 percent. The upper plate has a maximum width. The maximum width is 4 inches, plus or minus 10 percent. The upper plate has a center. The center is located on the central axis of the central shaft. The upper plate has a flat upper surface. In this manner a foot of the cheerleader is received. Further in this manner a foot of the cheerleader is held in a predetermined position while practicing athletic routines requiring balance and stamina. The upper platform is fabricated of alloy T-6063 aluminum. The alloy T-6063 aluminum is corrosion-dipped, electrostatic powder-coated. In this manner maximum durability is provided. The upper platform has a non-slip top. In this manner maximum safety is provided.

Further provided is a base plate. The base plate has a circular configuration. The base plate has a center. The center is located on the central axis of the central shaft. The base plate has a flat upper surface. The upper surface is provided in facing contact with the lower surface of the lower plate. The base plate has a diameter. The diameter is 14 inches, plus or minus 10 percent. The lower plate has a flat lower surface. The lower surface is positionable upon a floor. The base plate has a central aperture. The central aperture is axially aligned with the apertures of the lower plate. The lower surface of the base plate has a cylindrical recess. The circular recess has a diameter. The diameter is 4 inches, plus or minus 10 percent.

Provided last is a retainer disk. The retainer disk has a diameter of 4 inches, plus or minus 10 percent. The retainer disk is located within the recess. The retainer disk has a central aperture axially aligned with the apertures of the lower plate and the base plate. A bolt is provided. The bolt is provided through the apertures of the disk, base plate and lower plate. In this manner the system is threadedly joined for use. The entire system is fabricated of a rigid metallic material.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved cheerleader support system which has all of the advantages of the prior art support systems of known designs and configurations and none of the disadvantages.

It is another object of the present invention to provide a new and improved cheerleader support system which may be easily and efficiently manufactured and marketed.

It is a further object of the present invention to provide a new and improved cheerleader support system which is of durable and reliable constructions.

An even further object of the present invention is to provide a new and improved cheerleader support system which is susceptible of a low cost of manufacture with regard to both materials and labor, and which accordingly is then susceptible of low prices of sale to the consuming public, thereby making such cheerleader support system economically available to the buying public.

Even still another object of the present invention is to provide a cheerleader support system for receiving and holding a cheerleader in a predetermined position while practicing athletic routines requiring balance and stamina, the receiving and holding being done in a safe, convenient and economical manner.

Lastly, it is an object of the present invention to provide a new and improved cheerleader support system which has a vertically oriented shaft with a vertically oriented central axis, a lower plate configured with an upper surface integrally formed with the lower end of the shaft, an upper plate geometrically configured with a lower surface integrally formed with the upper end of the shaft and with upper surface, and a base plate having a center located on the central axis of the shaft. The base plate has an upper surface in facing contact with and separably coupled to the lower surface of the lower plate.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is a plan view of the system taken along line 3-3 of FIG. 2.

FIG. 4 is an exploded perspective illustration of a cheerleader support system as illustrated in the prior Figures.

The same reference numerals refer to the same parts throughout the various Figures.

DESCRIPTION OF THE PREFERRED EMBODIMENT

Figure 1:
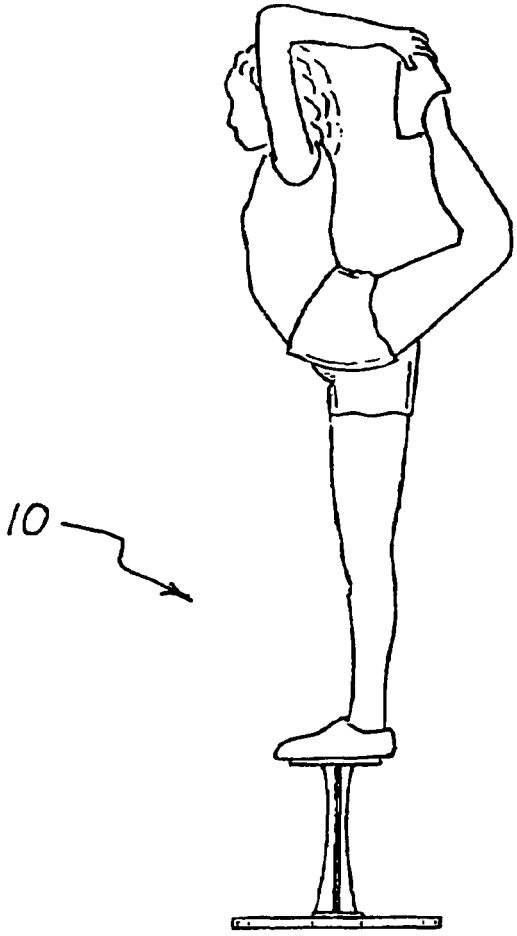
FIG. 1 is a side elevational view of a cheerleader support system constructed in accordance with the principles of the present invention, the system being illustrated while in use.
Figure 2:
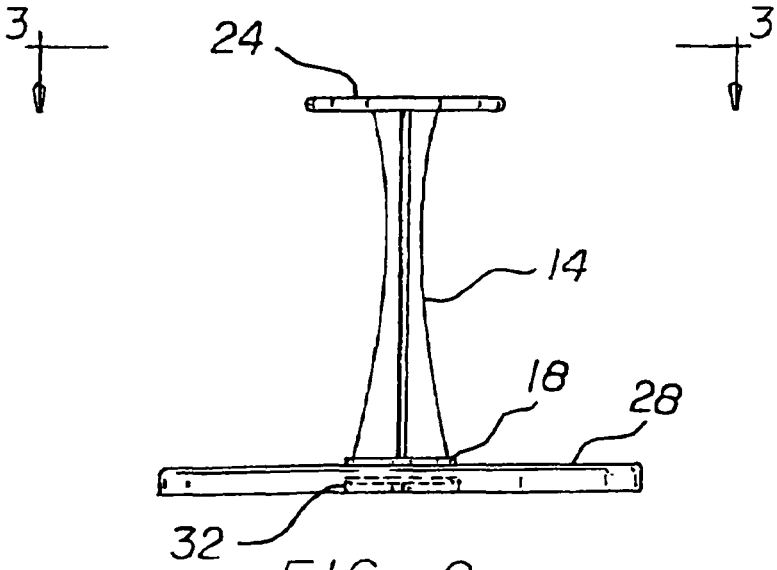
FIG. 2 is an enlarged side elevational view of the cheerleader support system shown in FIG. 1.

With reference now to the drawings, and in particular to FIG. 1 thereof, the preferred embodiment of the new and improved cheerleader support system embodying the principles and concepts of the present invention and generally designated by the reference numeral 10 will be described.

The present invention, the cheerleader support system 10 is comprised of a plurality of components. Such components in their broadest context include a vertically oriented shaft, a lower plate, an upper plate and a base plate. Such components are individually configured and correlated with respect to each other so as to attain the desired objective.

First provided is a vertically oriented central shaft 14. The central shaft has an upper end. The central shaft has a lower end. The central shaft has a vertically oriented central axis. The central axis is provided between the upper and lower ends. The central axis has a length of 14 inches, plus or minus 10 percent. The central has two planar sheets. The planar sheets are provided in a crossing pattern. The planar sheets have concave outer edges. The central shaft has a maximum width. The maximum width is provided adjacent to the upper and lower ends. The maximum width is not greater than 6 inches.

A lower plate 18 is provided. The lower plate has a configuration with a center. The center is located on the central axis of the central shaft. The lower plate has a flat upper surface. The upper surface is integrally formed with the lower end of the central shaft. The lower plate has a diameter. The diameter is 4 inches, plus or minus 10 percent. The lower plate has a flat lower surface. The lower plate has a central aperture 20.

Provided next is an upper plate 24. The upper plate has a generally rectangular configuration. The upper plate has short sides. The upper plate has concave long sides. The upper plate has a flat lower surface. The lower surface is integrally formed with the upper end of the central shaft. The upper plate has a maximum length. The maximum length is 9 inches, plus or minus 10 percent. The upper plate has a maximum width. The maximum width is 4 inches, plus or minus 10 percent. The upper plate has a center. The center is located on the central axis of the central shaft. The upper plate has a flat upper surface. In this manner a foot of the cheerleader is received. Further in this manner a foot of the cheerleader is held in a predetermined position while practicing athletic routines requiring balance and stamina practicing athletic routines. The upper platform is fabricated of alloy T-6063 aluminum. The alloy T-6063 aluminum is corrosion-dipped, electrostatic powder-coated. In this manner maximum durability is provided. The upper platform has a non-slip top. In this manner maximum safety is provided.

Further provided is a base plate 28. The base plate has a circular configuration. The base plate has a center. The center is located on the central axis of the central shaft. The base plate has a flat upper surface. The upper surface is provided in facing contact with the lower surface of the lower plate. The base plate has a diameter. The diameter is 14 inches, plus or minus 10 percent. The lower plate has a flat lower surface. The lower surface is positionable upon a floor. The base plate has a central aperture 30. The central aperture is axially aligned with the apertures of the lower plate. The lower surface of the base plate has a cylindrical recess 32. The circular recess has a diameter. The diameter is 4 inches, plus or minus 10 percent.

Provided last is a retainer disk 36. The retainer disk has a diameter of 4 inches, plus or minus 10 percent. The retainer disk is located within the recess. The retainer disk has a central aperture 38 axially aligned with the apertures of the lower plate and the base plate. A bolt 40 is provided. The bolt is provided through the apertures of the disk, base plate and lower plate. In this manner the system is threadedly joined for use. The entire system is fabricated of a rigid metallic material.

The present invention is a cheerleader balancing and core strengthening, height-sensitive training system. It provides a safe, stable platform. It is formed of high-strength extruded alloy T-6063 aluminum, corrosion-dipped, electrostatic powder-coated for maximum durability. It is a safe and stable platform for an inexperienced beginner to allow the building of skills at any level. It is stable, allowing the athlete to practice aligning his/her point of contact. The present invention has a non-skid top and rubberized foot to maintain solid contact with the shoe and floor at all times. It is ergonomically designed for weight to be distributed to outer perimeters of the foot for maximum weight distribution.

The present invention is designed for portability allowing the cheerleader to train anywhere without needing assistance from a teammate. It is collapsible for easy storage and transportation. It will conveniently fit into a travel bag or under a bed. The design is unique and effective duplicating and replicating a cheerleader's true motion of being lifted in the air. It allows a cheerleader to fine-tune his/her flying skills. It mimics being lifted by a teammate, making the user rely on only one foot, not both as if on the ground. It allows the athlete to use the other foot for making figures/stylistic movements/skills/stunts/acrobatic motion as is required in an actual performance. It allows cheerleaders to use either foot to balance their training on both sides of their body equally. It increases muscle-sensory and vertical-height awareness. It gives control and confidence to the athlete. The design is flexible. It can be accessorized with vinyl and decorative deals, allowing the cheerleader's individuality to be expressed. Teams can add their team colors. The present invention can be used as a seat while waiting. It can be used as a leg-stretching apparatus, training leg-dips. Two put together can be used to do deep push-ups. It can be used as a night/day stand, a shoe shining stool, a table-top, and a stepping stool. It is light weight making easy to carry. It is strong allowing a person of any size, i.e. coach/parent, to get on it to instruct and demonstrate a certain movement or pose.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A cheerleader support system (10) for receiving and holding a cheerleader in a predetermined position while practicing athletic routines requiring balance and stamina, the system comprising, in combination:

a vertically oriented central shaft (14) having an upper end and a lower end, the central shaft having a vertically oriented central axis between the upper and lower ends with a length of 14 inches, plus or minus 10 percent, the central shaft being formed of two planar sheets in a crossing pattern and having concave outer edges, the central shaft having a maximum width adjacent to the upper and lower ends of not greater than 6 inches;

a lower plate (18) having a configuration with a center located on the central axis of the central shaft, the lower plate having a flat upper surface integrally formed with the lower end of the central shaft, the lower plate having a diameter of 4 inches, plus or minus 10 percent, the lower plate having a flat lower surface, a central aperture (20) in the lower plate;

an upper plate (24) having a generally rectangular configuration with short sides and concave long sides, the upper plate having a flat lower surface integrally formed with the upper end of the central shaft, the upper plate having a maximum length of 9 inches, plus or minus 10 percent, and a maximum width of 4 inches, plus or minus 10 percent, the upper plate having a center located on the central axis of the central shaft, the upper plate having a flat upper surface for receiving and holding a foot of the cheerleader in a predetermined position while practicing athletic routines requiring balance and stamina, the upper platform being fabricated of alloy T-6063 aluminum, corrosion-dipped, electrostatic powder-coated for maximum durability, with a non-slip top for maximum safety;

a base plate (28) having a circular configuration with a center located on the central axis of the central shaft, the base plate having a flat upper surface in facing contact with the lower surface of the lower plate, the base plate having a diameter of 14 inches, plus or minus 10 percent, the lower plate having a flat lower surface positionable upon a floor, a central aperture (30) in the base plate axially aligned with the apertures of the lower plate, a cylindrical recess (32) centrally located in the lower surface of the base plate, the cylindrical recess having a diameter of 4 inches, plus or minus 10 percent; and a retainer disk (36) having a diameter of 4 inches, plus or minus 10 percent, located within the recess, a central aperture (38) in the disk axially aligned with the apertures of the lower plate and the base plate, a bolt (40) through the apertures of the disk, base plate and lower plate to threadedly join the system for use, the entire system being fabricated of a rigid metallic material.

* * * * *